US006945730B1

(12) United States Patent
Lobban

(10) Patent No.: US 6,945,730 B1
(45) Date of Patent: Sep. 20, 2005

(54) BOLLARD

(75) Inventor: Graham C. Lobban, St. Clements (CA)

(73) Assignees: RTS Plastics Inc., Waterloo; Redico, Inc., Buford, GA (US)

( * ) Notice: Subject to any disclaimer, the term of this patent is extended or adjusted under 35 U.S.C. 154(b) by 0 days.

(21) Appl. No.: 10/872,387

(22) Filed: Jun. 22, 2004

Related U.S. Application Data

(60) Provisional application No. 60/566,399, filed on Apr. 30, 2004.

(51) Int. Cl.[7] ..... E01F 9/013
(52) U.S. Cl. ..... 404/9; 256/13.1; 116/63 P
(58) Field of Search ..... 116/63 R, 63 P, 116/63 C; 404/6, 9, 10; 256/1, 13.1

(56) References Cited

U.S. PATENT DOCUMENTS

| | | | | |
|---|---|---|---|---|
| 3,925,929 | A * | 12/1975 | Montgomery | 49/35 |
| 4,104,839 | A | 8/1978 | Balzer et al. | |
| 4,106,879 | A * | 8/1978 | Diedershagen et al. | 404/10 |
| 4,290,585 | A * | 9/1981 | Glaesener | 256/13.1 |
| D263,454 | S | 3/1982 | Leung | |
| 4,358,090 | A * | 11/1982 | Glaesener | 256/13.1 |
| 4,407,505 | A * | 10/1983 | Kendziorski | 473/173 |
| 4,430,833 | A | 2/1984 | Balzer et al. | |
| 4,437,427 | A | 3/1984 | Mampaeij | |
| 4,438,484 | A | 3/1984 | Winden | |
| 4,576,508 | A | 3/1986 | Dickinson | |
| D290,410 | S | 6/1987 | Haggard | |
| 4,706,426 | A | 11/1987 | Rumsey | |
| 4,715,742 | A | 12/1987 | Dickinson | |
| 4,903,449 | A | 2/1990 | Ellingson, Jr. | |
| 4,977,851 | A * | 12/1990 | Anderson | 116/209 |
| 4,999,233 | A | 3/1991 | Probst et al. | |
| 5,018,902 | A | 5/1991 | Miller et al. | |
| 5,090,348 | A * | 2/1992 | Hugron | 116/63 P |
| D324,920 | S | 3/1992 | Miller et al. | |
| 5,207,175 | A * | 5/1993 | Andonian | 116/209 |
| D336,346 | S | 6/1993 | Miller et al. | |
| 5,397,197 | A | 3/1995 | Beavers | |
| 5,441,359 | A | 8/1995 | Filippi | |
| D362,200 | S | 9/1995 | Harris | |
| 5,468,093 | A * | 11/1995 | Voigt | 404/6 |
| 5,476,338 | A | 12/1995 | Alberts | |
| 5,487,618 | A | 1/1996 | Cox | |
| 5,508,078 | A | 4/1996 | Stalnaker | |
| 5,597,262 | A | 1/1997 | Beavers et al. | |
| 5,624,210 | A * | 4/1997 | Baldwin et al. | 405/232 |
| D400,278 | S | 10/1998 | Binsukor | |
| 5,829,913 | A | 11/1998 | Puckett | |
| D410,553 | S | 6/1999 | Compton | |
| D416,853 | S | 11/1999 | Aitken | |
| 6,035,567 | A * | 3/2000 | Cameron | 40/607.04 |
| D425,173 | S | 5/2000 | Landefeld | |
| D426,013 | S | 5/2000 | Landefeld | |
| 6,065,900 | A | 5/2000 | Reale | |
| 6,099,200 | A | 8/2000 | Pepe et al. | |
| D435,130 | S | 12/2000 | Landefeld | |

(Continued)

FOREIGN PATENT DOCUMENTS

| | | | |
|---|---|---|---|
| DE | 3815621 A1 * | 11/1989 | E01F 09/01 |

(Continued)

*Primary Examiner*—Thomas B. Will
*Assistant Examiner*—Alexandra Pechhold

(57) ABSTRACT

A bollard to be positioned in a predetermined location on a base. The bollard has an elongate body and a mounting element integrally attached to the body. The mounting element is adapted to be positioned in the base in the predetermined location, to locate the body on the base.

6 Claims, 10 Drawing Sheets

U.S. PATENT DOCUMENTS

| | | | | |
|---|---|---|---|---|
| D435,309 | S | 12/2000 | Landefeld | |
| D439,000 | S | 3/2001 | Landefeld | |
| D440,339 | S | 4/2001 | Landefeld | |
| 6,219,980 | B1 | 4/2001 | Peck, Jr. | |
| D443,094 | S | 5/2001 | Landefeld | |
| D444,899 | S | 7/2001 | Bossy | |
| 6,260,237 | B1 | 7/2001 | McCue et al. | |
| D447,250 | S | 8/2001 | Dionne et al. | |
| D447,822 | S | 9/2001 | Dionne et al. | |
| 6,283,453 | B1 | 9/2001 | Berget | |
| 6,341,877 | B1 | 1/2002 | Chong | |
| 6,345,930 | B1 * | 2/2002 | Mohassel | 404/9 |
| 6,402,337 | B1 | 6/2002 | LeVasseur et al. | |
| 6,416,248 | B1 * | 7/2002 | Clark | 404/10 |
| 6,422,783 | B1 * | 7/2002 | Jordan | 404/9 |
| 6,427,401 | B2 | 8/2002 | Bennett | |
| 6,484,472 | B2 | 11/2002 | Chi | |
| 6,485,225 | B1 | 11/2002 | Baker | |
| D470,598 | S | 2/2003 | Schneider et al. | |
| 6,514,006 | B1 | 2/2003 | Hines | |
| 6,536,364 | B1 | 3/2003 | McDermott | |
| D474,846 | S | 5/2003 | Skalka | |
| 6,601,355 | B2 | 8/2003 | Kreitz et al. | |
| 6,625,950 | B1 | 9/2003 | Shreiner et al. | |
| 2002/0152711 | A1 | 10/2002 | Schmitz | |
| 2004/0060500 | A1 * | 4/2004 | Parkhill et al. | 116/209 |
| 2004/0175213 | A1 * | 9/2004 | Reale | 404/6 |

FOREIGN PATENT DOCUMENTS

| | | | | |
|---|---|---|---|---|
| GB | 2159197 A | * 11/1985 | | E01F 09/00 |
| WO | WO 9500708 A1 | * 1/1995 | | E01F 09/01 |

* cited by examiner

BOLLARD

This application claims the benefit of U.S. Provisional Application No. 60/566,399, filed Apr. 30, 2004.

FIELD OF THE INVENTION

This invention is related to a bollard to be mounted to a base.

BACKGROUND OF THE INVENTION

Bollards which protect structures or machines in industrial, commercial and institutional premises are known. For example, a cement post (formed in situ) is often used as a bollard, to protect an exterior wall of a building or some other structure. Another typical bollard for exterior use is a steel post which is inserted into a base, typically gravel or soil. Often, the steel post bollard is cemented in place in the base. Yet another known bollard for exterior use is a steel post which has been filled with cement.

Bollards for interior use, which are used to protect interior walls, structural elements of the building, or machinery or displays, also can be cement, steel, or cement-and-steel posts placed in or on a floor. However, bollards are also known which are for use in retail premises, for example, to prevent collisions of shopping carts with equipment such as freezers and refrigerators. Such known bollards are often relatively heavy, and usually are permanently installed.

However, known bollards suffer from a number of defects. Whether for interior or exterior use, the typical bollard is constructed to withstand a relatively strong blow, and because of this, many known bollards are relatively heavy and of solid construction, and most are permanently installed. Accordingly, removal of known bollards is usually difficult. Because most known bollards are installed so that their removal is only achievable with great effort and difficulty, they are not removed until replacement. However, the temporary removal of an interior bollard is often desirable, for example, to permit easier cleaning of a floor surface in the vicinity of the bollard. Also, moving a bollard is sometimes desirable, in connection with remodelling or reconfiguration of the premises, which typically is required from time to time.

U.S. Pat. No. 6,260,237 (McCue et al.) discloses a bollard for interior use which is intended to be relatively lightweight and is also intended to be relatively easily removed. However, the bollard disclosed in McCue et al. includes a leg structure secured to a rear wall of the bollard's body and a horizontal rail secured to a front wall of the body. The rear wall includes an upper retainer housing and a lower retainer housing in which the leg structure is retained.

The bollard disclosed in McCue et al. suffers from the defect that it includes a relatively large number of discrete parts. The cost of manufacturing this bollard may therefore be relatively high. Also, because the parts are discrete, one or more parts of the McCue et al. bollard may separate after prolonged usage.

There is therefore a need for an improved bollard for mounting to a base.

SUMMARY OF THE INVENTION

In a broad aspect, the invention provides a bollard to be positioned in a predetermined location on a base. The bollard has an elongate body and a mounting element integrally attached to the body. The mounting element is adapted to be positioned in the base in the predetermined location, to locate the body on the base.

In another aspect, the mounting element has one or more posts for insertion in one or more holes in the base, to position the post at the predetermined location.

In yet another aspect, the body includes a front wall and a substantially opposed rear wall and the mounting element includes one or more connecting members connecting the posts to the front wall, the connecting members being integrally secured in the front wall.

In yet another aspect, each connecting member includes an interior part with a wall contact portion integrally secured to the front wall and an external part extending outside the body to the exposed part of the bumper.

In another aspect, the invention provides a bollard assembly adapted to be positioned on a base. The bollard assembly includes a bollard and one or more receptacles. The bollard has an elongate body with a bottom end adapted for engagement with the base, and a mounting element for mounting the body to the base. The mounting element has an internal portion positioned inside the body and integrally attached to the body, and one or more external portions connected to said at least one internal portion. Each external portion of the mounting element extends from the bottom end of the body, and the body is located on the base by the external portion. Each receptacle is adapted for positioning in the base and receiving one of the external portions so that the bottom end engages the base.

In yet another aspect, each receptacle includes a housing defining a hole in which the external portion is receivable. The housing has a housing bottom end, to be located in the base, and a housing top end, positioned distal to the housing bottom end. The receptacle also includes a flange portion extending transversely from the top end of the housing, for cooperating with a top surface of the base to sit on the surface, and thereby to locate the bottom end of the housing a predetermined depth below the surface.

In yet another aspect, the invention provides a bollard to be mounted on a base. The bollard includes an elongate body having a bottom end adapted for engagement with the base, and a mounting element for mounting the body to the base. The mounting element has an internal portion positioned at least partly inside the body and integrally attached to the body, and one or more external portions connected to the internal portion. The external portion extends from the bottom end of the body and is adapted to locate the body on the base.

In yet another aspect, the invention provides a method of mounting a bollard on a base. The method includes, as a first step, providing a bollard having an elongate body with a bottom end adapted for engagement with the base and a mounting element for mounting the body to the base. Next, providing one or more holes in the base in which one or more external portions are receivable. Finally, inserting the external portion into the hole.

BRIEF DESCRIPTION OF THE DRAWINGS

The invention will be better understood with reference to the attached drawings, in which.

DETAILED DESCRIPTION OF THE PREFERRED EMBODIMENT(S)

Figure 1A:
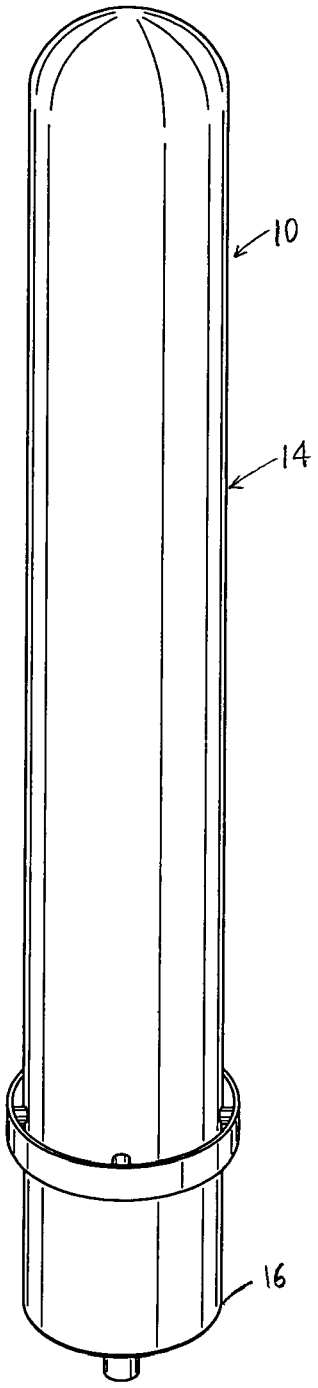
FIG. 1A is an isometric view of a preferred embodiment of the bollard of the invention.

Reference is first made to FIGS. 1A–1E and 2A–2C to describe a preferred embodiment of a bollard in accordance with the invention indicated generally by the numeral 10. The bollard 10 is to be mounted on a base or floor 12 (FIG. 1D) in a predetermined location. The bollard 10 has an elongate body 14 with a bottom end 16 adapted for engagement with the base 12, as will be described. The bollard 10 also includes a mounting element 18 (FIGS. 2A–2C) integrally attached to the body 14. As will be described, the mounting element 18 is adapted to be positioned in the base 12 in the predetermined location, to locate the body 14 on the base 12.

Preferably, the mounting element 18 has one or more posts 19. Each post 19 is adapted for insertion in one or more holes 20 in the base 12, to position the post 19 in the predetermined location. In the preferred embodiment, the post 19 is receivable in the hole 20 in a clearance fit between the post 19 and the hole 20. Because the post 19 fits into the hole 20 in a clearance fit, the post 19 is easily removable from the hole 20. The post 19 includes an external part 24 which extends beyond the body 14 and is receivable in the hole 20.

Figure 1B:
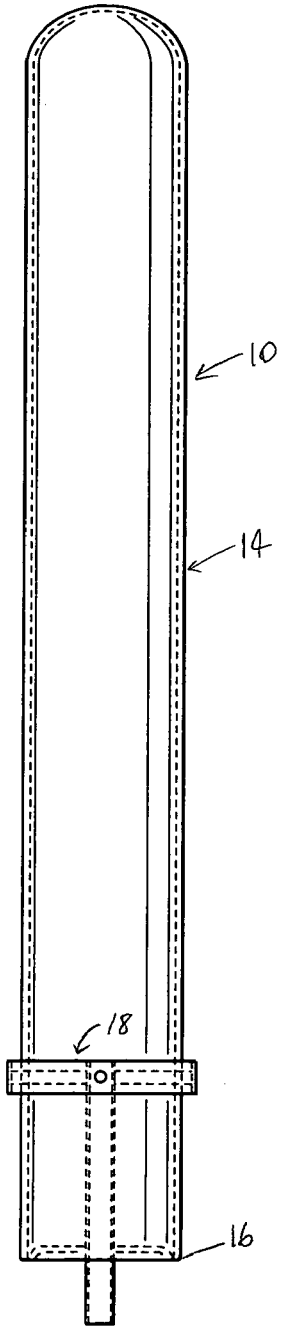
FIG. 1B is a side view of the bollard of FIG. 1A.
Figure 1C:
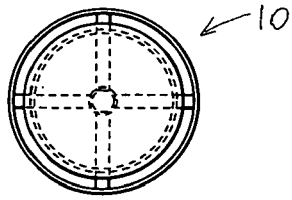
FIG. 1C is a top view of the bollard of FIG. 1A.
Figure 2A:
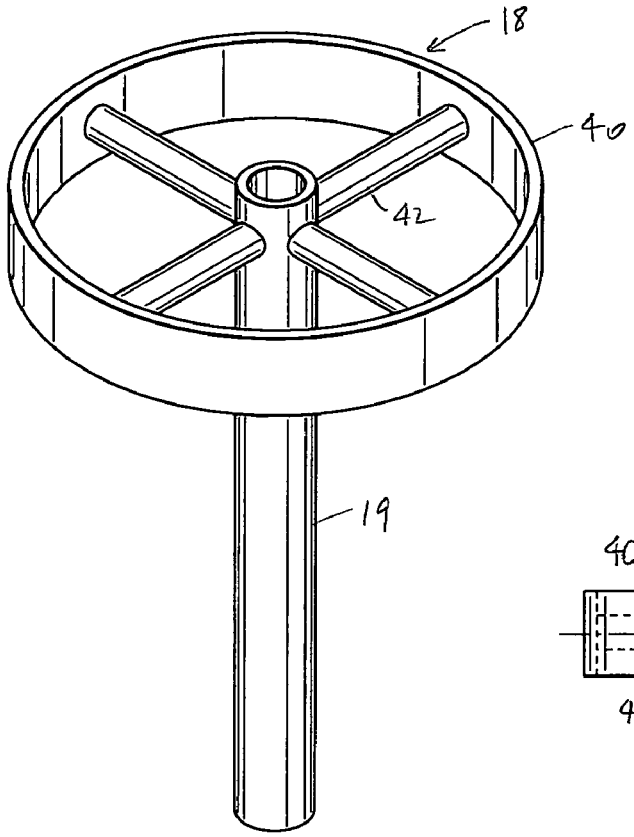
FIG. 2A is an isometric view of a preferred embodiment of the mounting element of the invention, drawn at a larger scale.
Figure 2B:
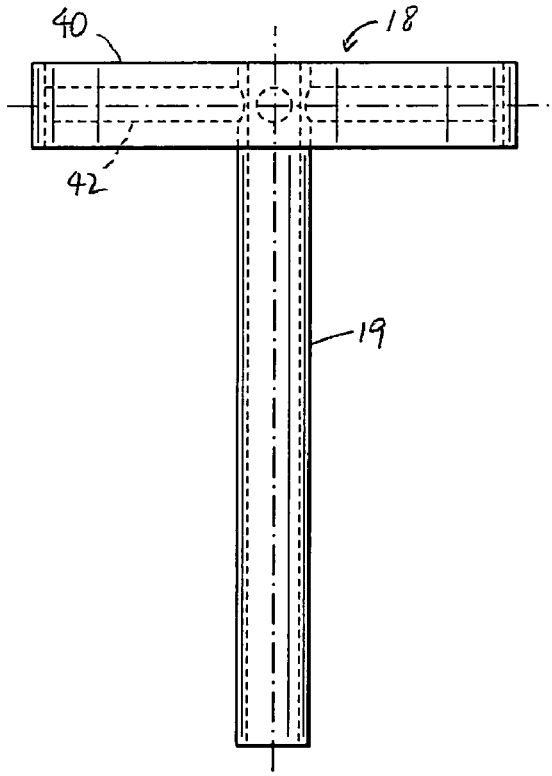
FIG. 2B is a side view of the mounting element of FIG. 2A.
Figure 2C:
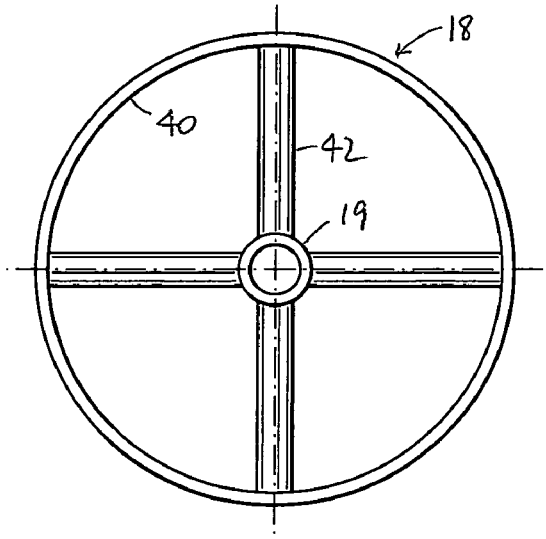
FIG. 2C is a top view of the mounting element of FIG. 2A.

The mounting element 18 has an internal portion 22 which is integrally attached to the body 14 (as will be described), and one or more external portions 23 connected to the internal portion 22. The external portion 23 is adapted to be mounted to the base 12 for supporting the body 14 above the base 12. As can be seen in FIGS. 1B, 2A and 2B, the external portion 23 includes the external part 24 of the post 19. In the preferred embodiment, the mounting element 18 is also adapted to protect the body 14, as will be described.

Preferably, the body 14 includes a substantially hollow tube 30 with a body wall 32 having an exterior surface 33. In the preferred embodiment, the tube 30 is substantially defined by a longitudinal axis 34 (FIG. 1D), with which the tube 30 is coaxial, and a rounded cap portion 36. The rounded cap portion 36 is located at a top end 38, which is distal to the bottom end 16.

Figure 1D:
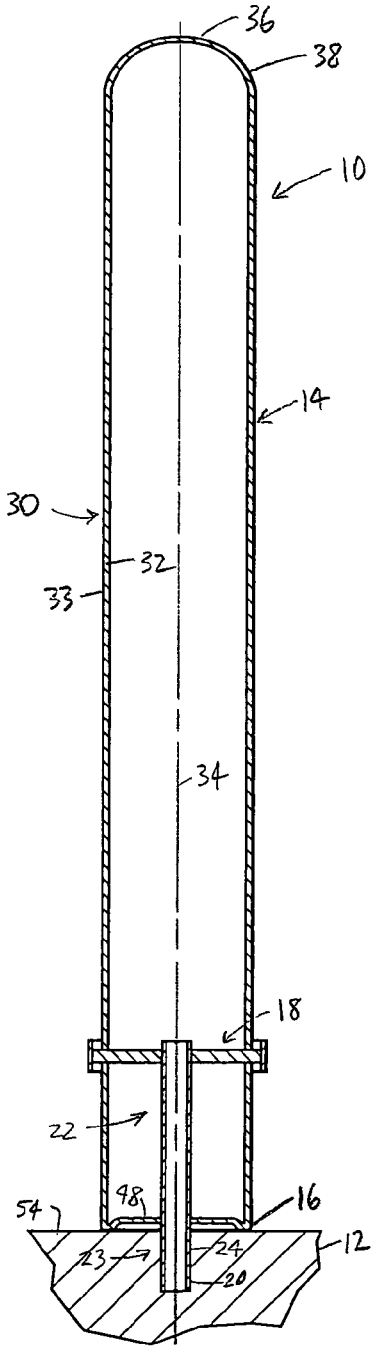
FIG. 1D is a cross-section taken from the side of a preferred embodiment of the bollard of FIG. 1A, mounted on a base.

In the preferred embodiment, the mounting element 18 additionally includes a bumper 40 connected to the post 19 by one or more connecting members 42. Preferably, each connecting member 42 includes an internal part 44 with a wall contact portion 45 (FIGS. 1E, 3B) integrally coupled with the wall 32 and an external part 46 positioned outside the body 14, to support the exposed part 43 of the bumper 40. As can be seen in FIGS. 1B and 1D, each connecting member 42 positions the bumper portion 40 outside the body 14 a predetermined distance from the exterior surface 33 of the wall 32, to protect the body 14.

It will be appreciated by those skilled in the art that the bumper 40 could be connected to the post 19 by a variety of structures. In the preferred embodiment, a plurality of connecting members 42 connect the bumper 40 and the post 19. The connecting members 42 are preferably in the form of spokes, or rods, extending radially from the post 19 and positioned substantially radially equidistant from each other. Although a mounting element which includes spokes is relatively cost-effective and light-weight, however, other structures could be used to function as one or more connecting members. The mounting element 18 is preferably made of stainless steel or any other suitable material.

Preferably, the wall 32 is manufactured from commercial grade UV-stabilized polyethylene resin, or any other suitable plastic. The body 14 is preferably formed by rotational molding. The mounting element 18 is integrally molded into the wall 32 when the body 14 is rotationally molded. Accordingly, before the body 14 is created, the mounting element 18 is positioned in the mold (not shown). Heated plastic material which will form the body 14 is then added to the mold.

As is known in the art, in rotational molding, the heated plastic is subjected to centrifugal force, developed by rotating the mold at high speed. The plastic body 14 formed in this way is virtually stress-free, and the wall 32 is of substantially uniform thickness. The body 14 can be formed with plastic material having any of a variety of colors. As the plastic material cools, the plastic bonds to the wall contact portion 45 of the connecting member 42, so that the mounting element 18 is thereby integrally coupled to the body 14.

Figure 1E:
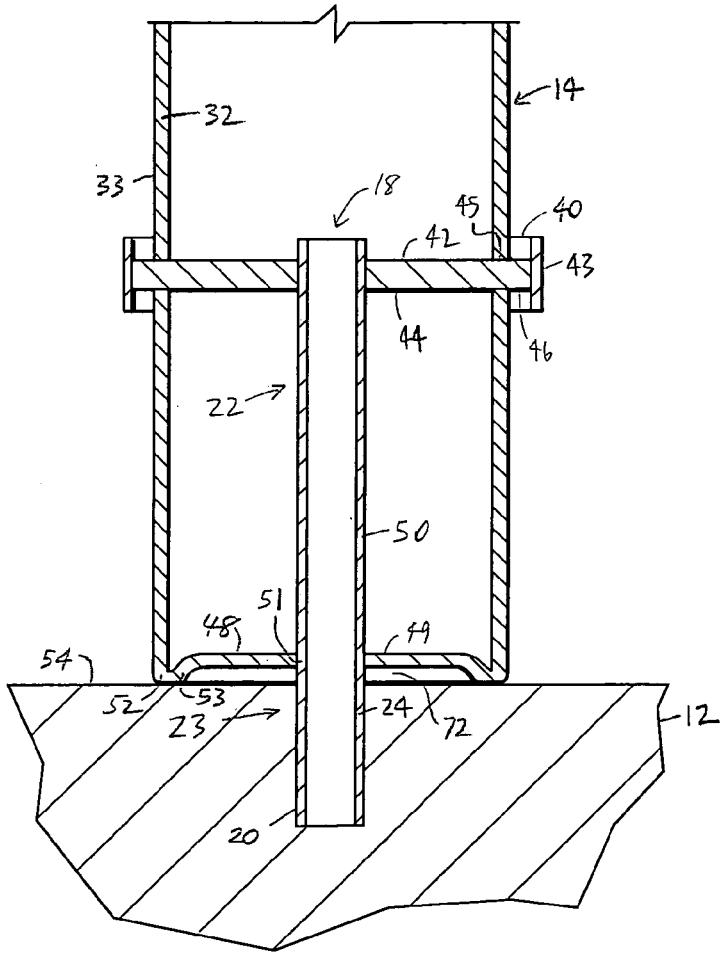
FIG. 1E is a cross-section of a portion of the bollard of FIG. 1D, drawn at a larger scale.
Figure 3B:
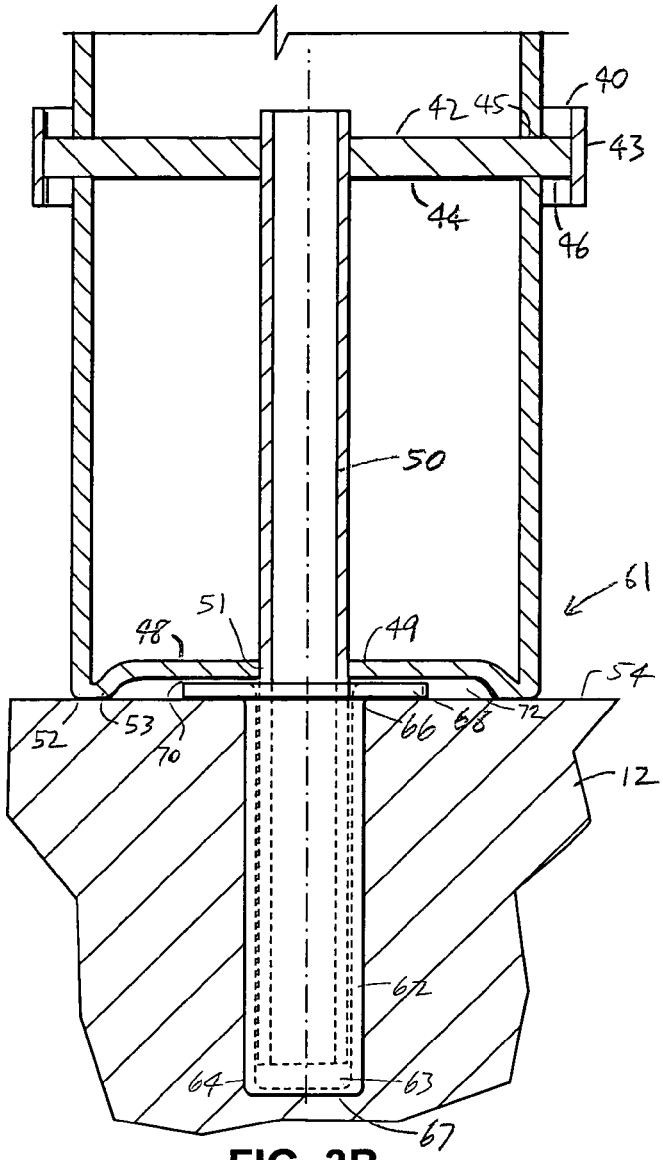
FIG. 3B is a cross-section taken from the side of the receptacle of FIG. 3A showing the bollard of FIG. 1A in position therein.

The body 14 preferably includes an end cap 48 positioned around the post 19 and extending from the post 19 to the wall 32. The end cap 48 preferably includes a central portion 49 located adjacent to the post 19. As can be seen in FIGS. 1D, 1E, and 3B, the central portion 49 is preferably located substantially above the base 12 when the bollard 10 is positioned on the base 12.

The end cap 48 is formed in the rotational mold when the tube 30 is formed, and the end cap 48 is integrally coupled to the wall 32 accordingly. As can be seen in FIGS. 1E and 3B, the post 19 has an internal part 50 with a cap contact portion 51 to which the plastic material comprising the end cap 48 has bonded (i.e., due to the post 19 being fixed in place when the body 14 and the end cap 48 are formed by rotational molding), so that the post 19 is integrally attached to the end cap 48.

Preferably, and as can be seen in FIGS. 1E and 3B, the wall 32 terminates at the bottom end 16 in a contact surface 52. The contact surface 52 is adapted to seat upon the base 12, i.e., the contact surface 52 cooperates with the surface 54 so that the body 14 rests or fits securely on the base 12. In most cases, the base (or floor) 12 has a surface 54 which is substantially planar. Accordingly, where the surface 54 is substantially planar, the contact surface 52 forms a ring which is substantially planar, to enable the contact surface 52 to be seated securely upon the substantially planar top surface 54 of the base 12. As shown in FIG. 1E, the end cap 48 preferably also includes a segment 53 which is partly coplanar with the contact surface 52.

In the preferred embodiment, and as shown in FIG. 1E, the end cap 48 has a substantially concave shape facing the base 12. The generally concave shape of the end cap 48 is preferred because it facilitates the stable seating of the body 14 upon the surface 54 of the base 12. As shown in FIGS. 1D and 1E, to this end, it is also preferred that the body 14 includes a contact surface 52 configured to cooperate with the surface 54 for stable seating, as described.

Figure 3A:
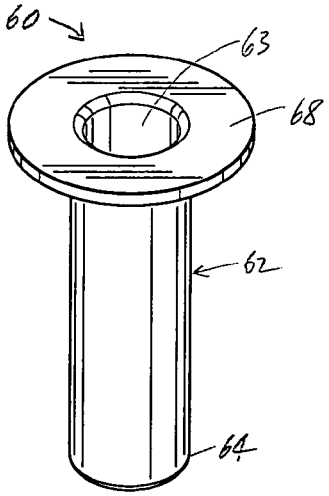
FIG. 3A is an isometric view of a preferred embodiment of the receptacle of the invention.
Figure 3C:
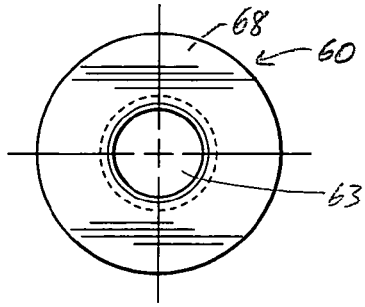
FIG. 3C is a top view of the receptacle of FIG. 3A.

A receptacle 60, to be positioned in the base 12 for receiving the external portion 23 of the mounting element 18, is shown in FIGS. 3A–3C. Preferably, the receptacle 60 includes a housing 62 defining a hole 63 therein. As can be seen in FIGS. 3A–3C, the housing 62 preferably includes a housing bottom end 64 and a housing top end 66 positioned distal to the bottom end 64. The receptacle 60 also includes a flange portion 68 extending transversely from the top end 66 of the housing 62 for cooperating with the surface 54 of the base 12 to position the bottom end 64 a preselected depth below the surface 54 of the base 12. In the preferred embodiment, the bottom end 64 includes an end wall portion 67 closing off the bottom end 64 of the housing 62, partly defining the hole 63.

The preferred embodiment of a bollard assembly 61 of the invention includes the bollard 10 and the receptacle 60 (FIG. 3B). In the preferred embodiment, the external portion 23 of the mounting element 18 is receivable in the hole 63 in a clearance fit. This is preferred because the bollard 10 may be required to be removed from time to time, e.g., to permit cleaning of the floor surface 54 in the vicinity of the flange portion 68, and generally any parts of the surface 54 which are covered by the bollard 10 when the bollard 10 is mounted on the floor 12.

In use, the hole 20 is provided in the base or floor 12 (FIGS. 1D, 1E). The hole 20 is sufficiently large to receive the external portion 23 of the mounting element 18. Where the bollard 10 is to be positioned for exterior use (i.e., outside a building), the hole 20 is dug or otherwise made in the base 12, and the external portion 23 inserted into the hole 20. Suitable material may be used to backfill around the external portion 23 after insertion into the hole 20.

Where the bollard 10 is to be mounted in an interior location, the receptacle 60 is preferably positioned in the hole 20 in the floor 12. The flange portion 68 cooperates with the surface 54 of the floor 12 to position the bottom end 64 of the housing 62 at a preselected depth below the surface 54. The external portion 23 is preferably inserted into the hole 63 of the receptacle 60 in a clearance fit. Where the external portion 23 is received in a clearance fit, the external portion 23 is easily removable from the receptacle 60, for example, to permit cleaning of the floor surface 54 in the vicinity of the receptacle 60.

As shown in FIG. 3B, the concavity of the central portion 49 provides a recess 72 in which the flange portion 68 of the receptacle 60 is receivable. Preferably, the central portion 49 is configured to result in a gap 70 between the flange portion 68 and the end cap 48 when the bollard 10 is in position in the receptacle 60. Due to the gap 70, the contact surface 52 and the segment 53 seat on the surface 54 of the base 12, as shown in FIG. 3B.

Similarly, the configuration of the central portion 49 of the end cap 48 (i.e., so that the central portion 49 arches above the surface 54 when the bollard 10 is mounted to the base 12) permits proper seating of the body 30 on the base 12 when the bollard 10 is used without the receptacle 60. As shown in FIG. 1E, the central portion 49 is preferably configured to be spaced apart from the surface 54 so that the recess 72 between the central portion 49 and the surface 54 results when the bollard 10 is mounted in the hole 20.

It will be appreciated by those skilled in the art that the receptacle 60, although preferred, is not needed for interior installations. For example, the external part 26 of the post 19 can be inserted directly into the hole 20 in the floor 12. Also, an interference fit may be used instead of a clearance fit, for example, where the bollard 10 is not intended to be moved frequently, or at all.

Additional embodiments of the invention are shown in FIGS. 4A–4C, 5A –5C, 6A–6C, 7A–7C, 8A–8C, and 9A–9B. In such drawings, elements are numbered so as to correspond to like elements shown in FIGS. 1A–1E, 2A–2C, and 3A –3C.

An alternative embodiment 110 of the bollard of the invention includes a body 114 in which a mounting element 118 is integrally secured. The bollard 110 is intended primarily for exterior use, as will be described. The mounting element 118 includes a post 126 with a first end 127 positioned distal to a bottom end 116 of the body 114. The body 114 includes a substantially hollow tube 130 with a body wall 132, the tube 130 being substantially coaxial with a longitudinal axis 134. In addition, the post 126 includes an aperture 129 in the first end 127 positioned substantially transverse to the longitudinal axis 134. The bollard 110 also includes a retainer pin 131 which is receivable in the aperture 129, for retaining the first end 127 in the base 12.

Figure 4A:
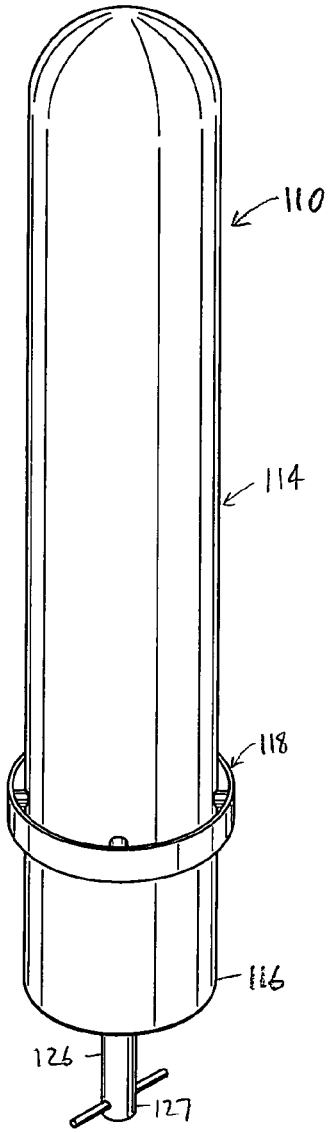
FIG. 4A is an isometric view of an alternative embodiment of the bollard of the invention, drawn at a smaller scale.
Figure 4B:
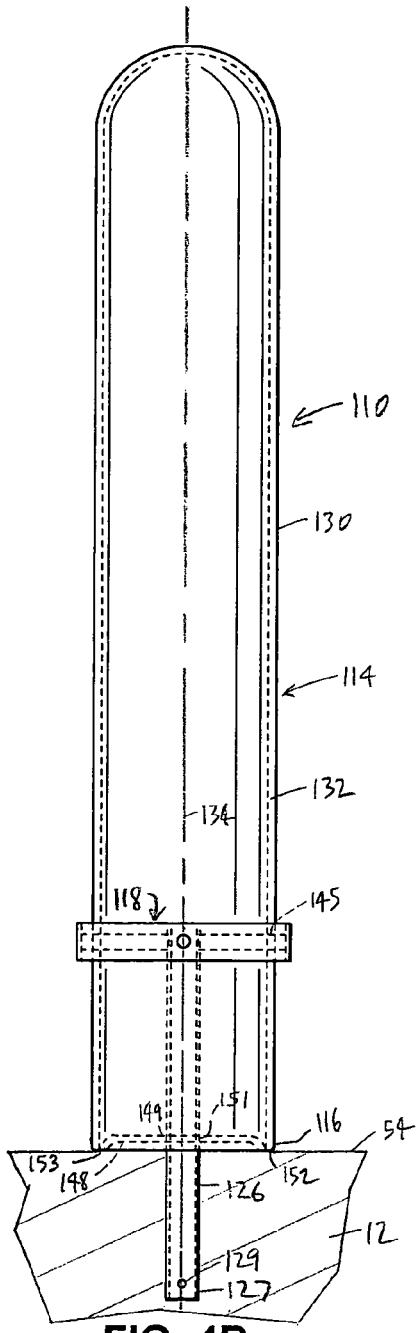
FIG. 4B is a side view of the bollard of FIG. 4A.
Figure 4C:
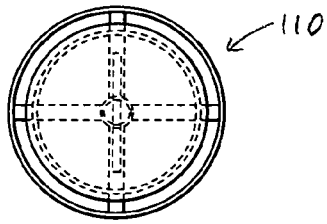
FIG. 4C is a top view of the bollard of FIG. 4A.
Figure 5A:
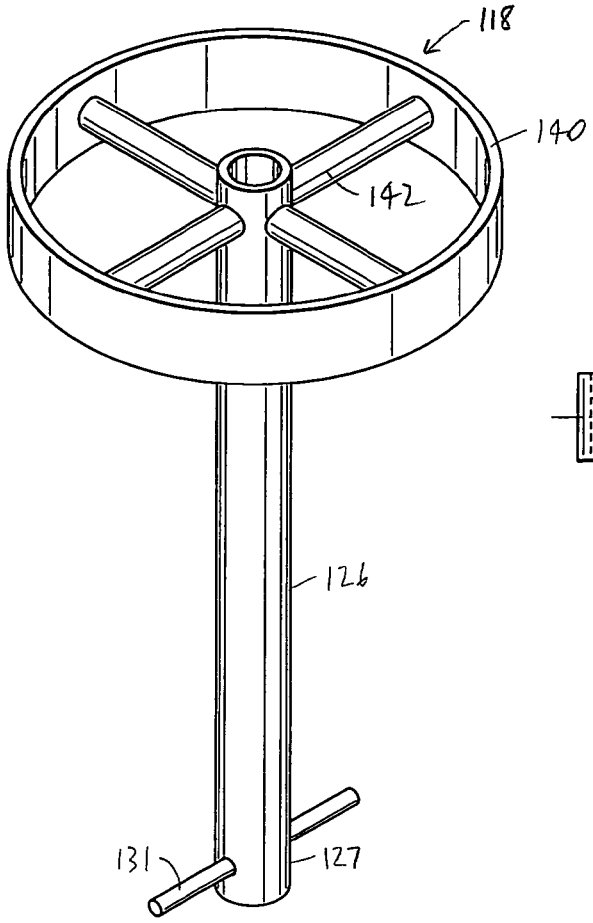
FIG. 5A is an isometric view of an alternative embodiment of the mounting element, drawn at a larger scale.
Figure 5B:
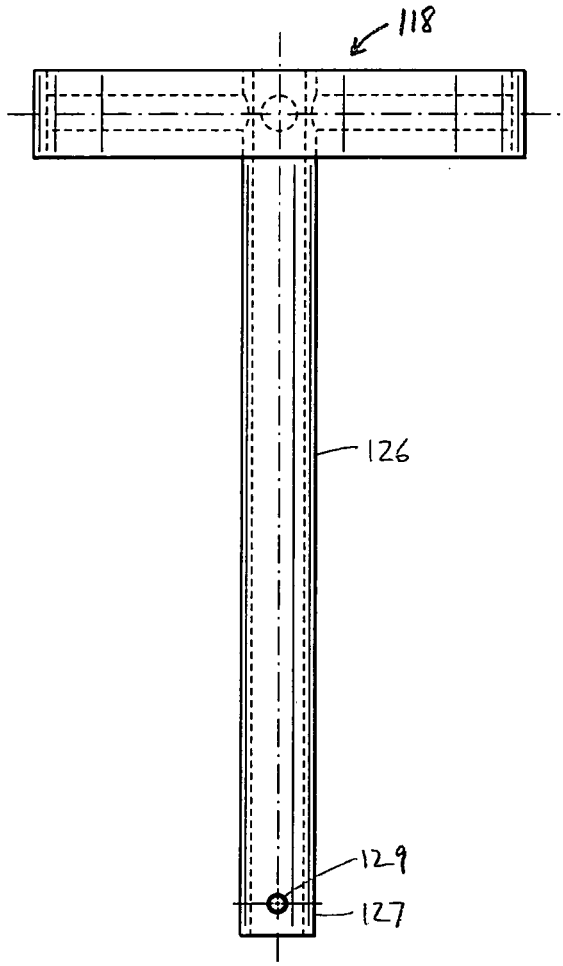
FIG. 5B is a side view of the mounting element of FIG. 5A.
Figure 5C:
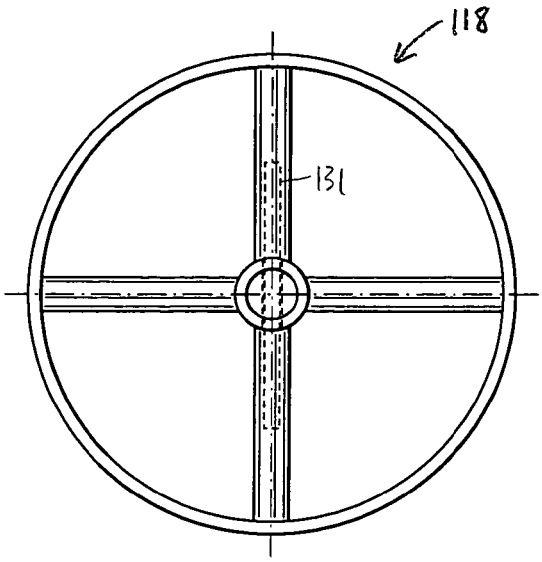
FIG. 5C is a top view of the mounting element of FIG. 5A.

Preferably, and as shown in FIGS. 5A–5C, the mounting element 118 includes a bumper 140 connected to the post 126 by a plurality of connecting members 142. The connecting members 142 each extend through the wall 132 to support the bumper 140 at a predetermined position spaced apart from an exterior surface 133 of the wall 132. Each connecting member 142 includes a wall contact portion 145 (FIG. 4B) which is integrally attached to the wall 132, because the mounting element 118 was molded in place when the body 114 was formed using rotational molding.

Similarly, the post 126 includes a cap contact portion 151 which is integrally attached to an end cap 148 at a central portion 149 thereof. As shown in FIG. 4B, the central portion 149 is positioned so that, when the bollard 110 is mounted on the base 12, the central portion 149 is positioned above the surface 54 of the base, and spaced apart from the surface 54. The body 114 preferably includes a contact surface 152 at the bottom end 116 of the wall 134, configured to seat upon the surface 54 in a stable manner. Also, the end cap 148 preferably includes a segment 153 which joins the central portion 149 to the wall 132 and also seats upon the surface 54, the segment 153 preferably being at least partially coplanar with the contact surface 152.

In use, the retainer pin 131 is inserted in the aperture 129, after which an external part 124 of the post 126 is inserted into a hole 20 (FIG. 4B) excavated in the base 12 for the purpose. After the external part 124 is inserted into the hole, a suitable material is backfilled around the external part 124, to provide support to the external part 124. Also, the backfill is for supporting the body 114, by supporting the contact portion 152 and the segment 153. The backfill material can be gravel or cement or any other suitable material. Reuse of the bollard 110 may be possible following excavation thereof, but is generally not feasible.

An alternative embodiment 210 of the bollard is shown in FIGS. 6A–6C and 9A–9B. The bollard 210 has a body 214 with a bottom end 216 adapted for engagement with the base 12. The bollard 210 also includes a mounting element 218 (FIGS. 7A–7C) integrally secured in the body 214, as will be described. As can be seen in FIGS. 6B, 6C, and 7A–7C, the mounting element 218 preferably includes two posts 225, 226. Preferably, the posts 225, 226 are positioned substantially parallel to each other and are spaced apart from each other by a preselected distance. Each of the posts 225, 226 includes an external part respectively 224 extending from the bottom end 216 of the body 214 and positioned for insertion in a respective preselected hole 20 in the base 12. Preferably, the external parts 224 are each receivable in the holes 20 in a clearance fit, so that they are easily removable if required. However, if preferred, the external parts 224 may fit into the holes 20 in an interference fit.

Figure 6A:
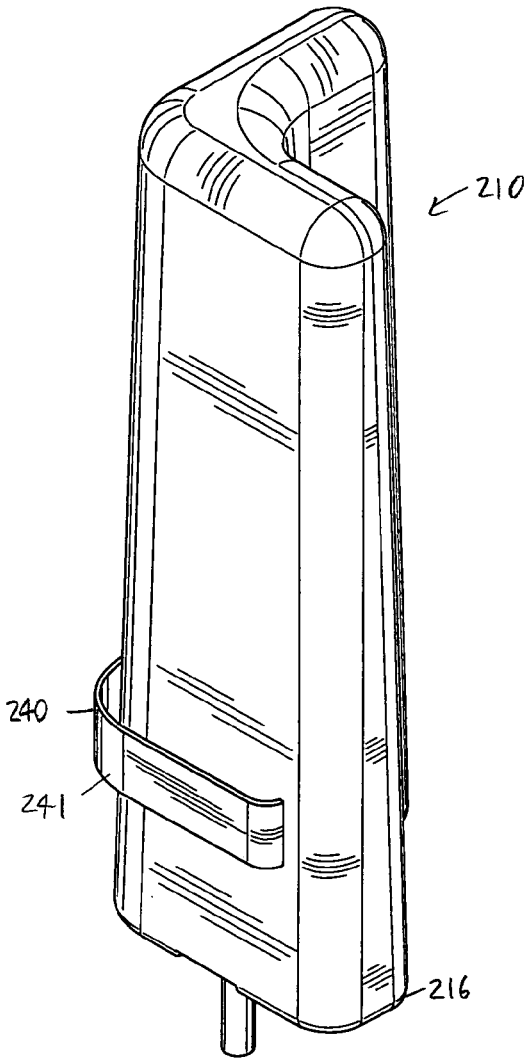
FIG. 6A is an isometric view of an alternative embodiment of the bollard of the invention, drawn at a smaller scale.
Figure 6B:
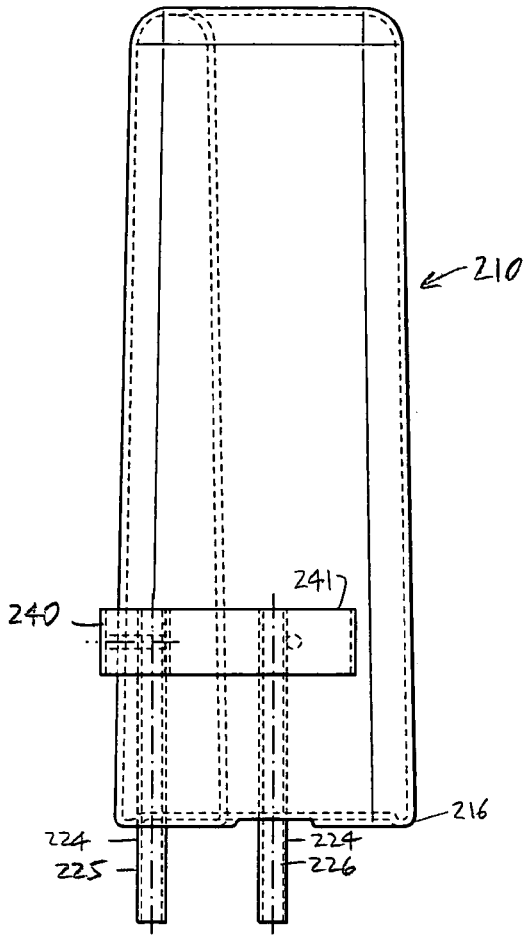
FIG. 6B is a side view of the bollard of FIG. 6A.
Figure 6C:
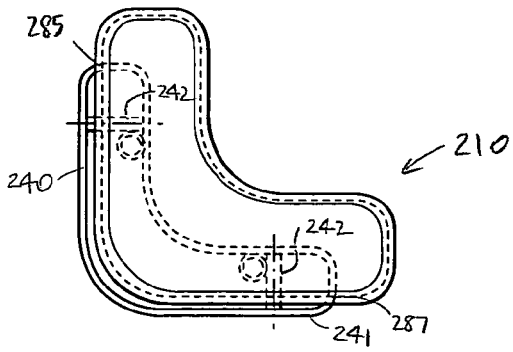
FIG. 6C is a top view of the bollard of FIG. 6A.
Figure 7A:
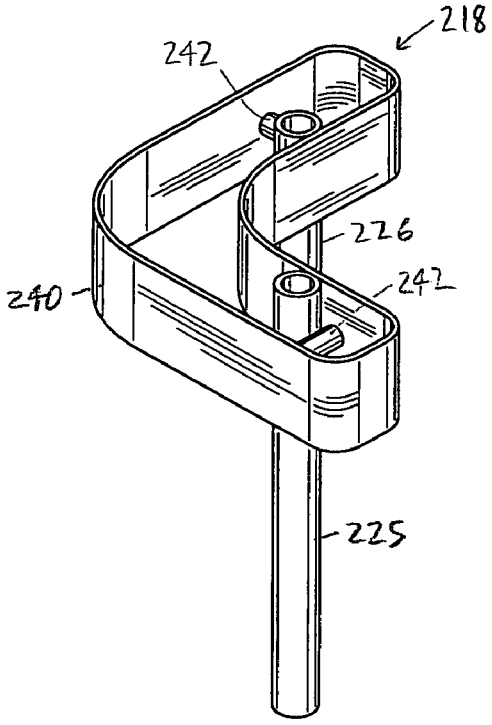
FIG. 7A is an isometric view of the alternative embodiment of the mounting element included in the bollard of FIG. 7A, drawn at a larger scale.
Figure 7B:
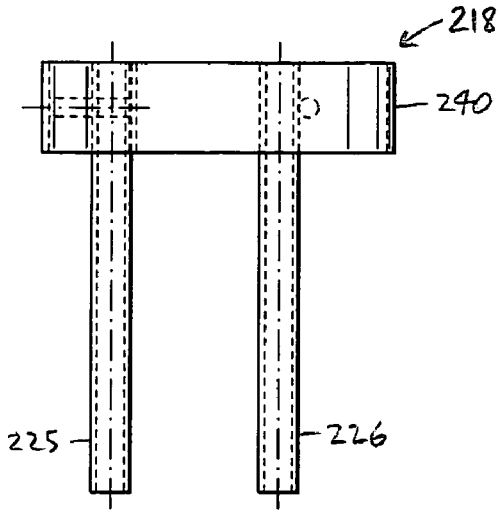
FIG. 7B is a side view of the mounting element of FIG. 7A.
Figure 7C:
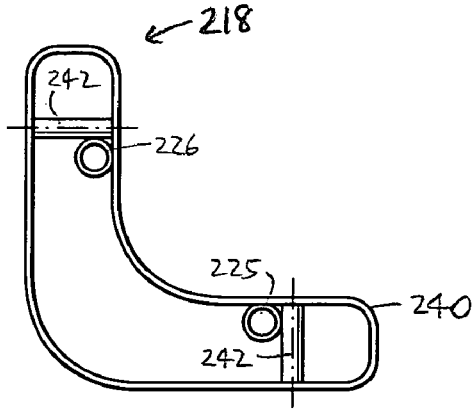
FIG. 7C is a top view of the mounting element of FIG. 7A.

As can be seen in FIGS. 6A–6C, the bollard 210 is preferably shaped to provide protection to a corner or projection of a structure or equipment (not shown). The body 214 (shown in FIGS. 8A–8C) includes a central portion 275 which is flanked by two side portions 277, 279. The side portions 277, 279 are preferably positioned to define an obtuse angle relative to each other. However, the positioning of the side portions 277, 279 relative to each other can be varied as required for specific applications. The body 214 also has a top end 238 which is preferably rounded, to minimize the risk that the clothing of people passing near the bollard 210 or articles moved past the bollard 210 may be caught or scratched by the bollard.

Figure 8A:
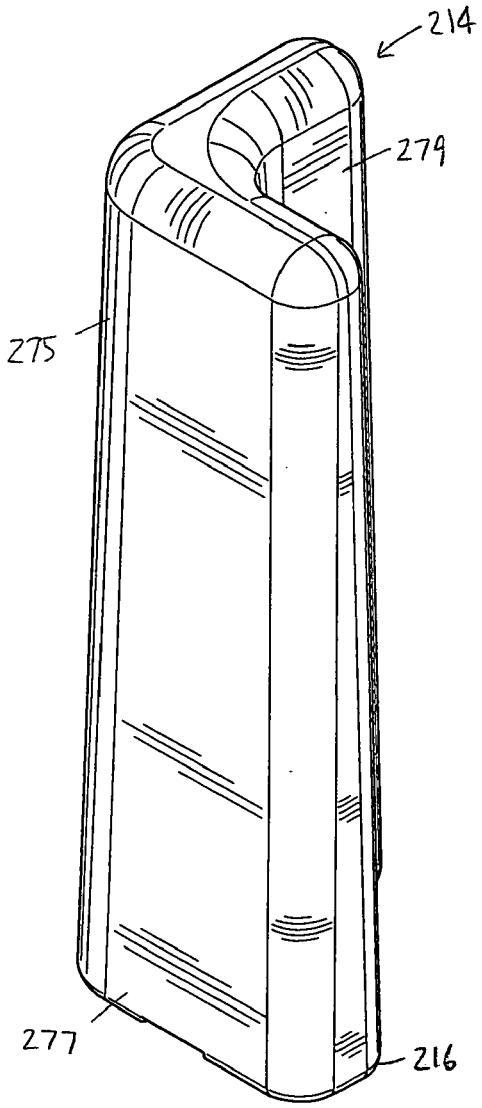
FIG. 8A is an isometric view of the alternative embodiment of the body included in the bollard of FIG. 6A, drawn at a smaller scale.
Figure 8B:
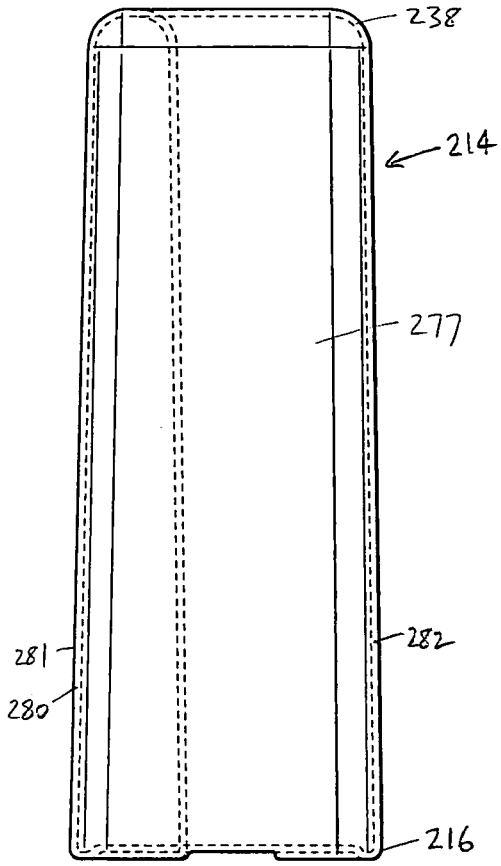
FIG. 8B is a side view of the body of FIG. 8A.
Figure 8C:
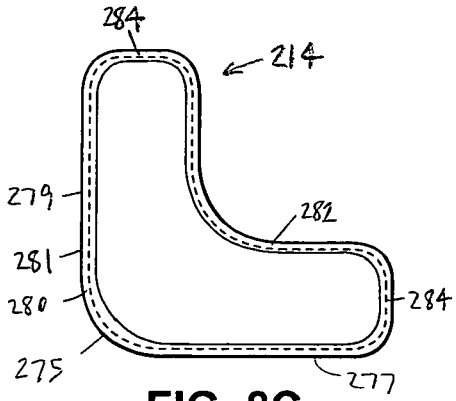
FIG. 8C is a top view of the body of FIG. 8A.

The body 214 has a front wall 280 with a front exterior surface 281 and a substantially opposed rear wall 282. The front and rear walls 280, 282 preferably extend throughout the side portions 277, 279 and the central portion 275. As can be seen in FIG. 8C, the front wall 280 and the rear wall 282 are preferably joined by side walls 284 to form a continuous wall around the body 214. However, it will be evident to those skilled in the art that many different body shapes are possible, and the body 214 could be formed without side walls 284.

The mounting element 218 is integrally attached to the front wall 280 of the body 214. The posts 225, 226 are positioned proximal to the front wall 280 because such positioning results in somewhat greater free floor space than would have resulted if, for example, the posts 225, 226 had been positioned adjacent to the rear wall 282. The mounting element 218 is integrally attached to the front wall 280 (i.e., and is not attached to the rear wall 282) in order to locate the posts 225, 226 proximal to the front wall 280.

In addition, the mounting element 218 includes a bumper 240 connected to the posts 225, 226 by one or more connecting members 242. Each connecting member 242 is integrally attached to the front wall 280 of the body 214, as will be described. In addition, each connecting member 242 extends through the front wall 280 to support an exposed part 241 of the bumper 240 a predetermined distance outside the front wall 280, for protecting the body 214. Each connecting member 242 is preferably also directly connected to one of the posts 225, 226 respectively to strengthen the mounting element 218. As shown in FIG. 6C, the bumper 240 also includes an internal part 243 positioned inside the body 214.

Figure 9A:
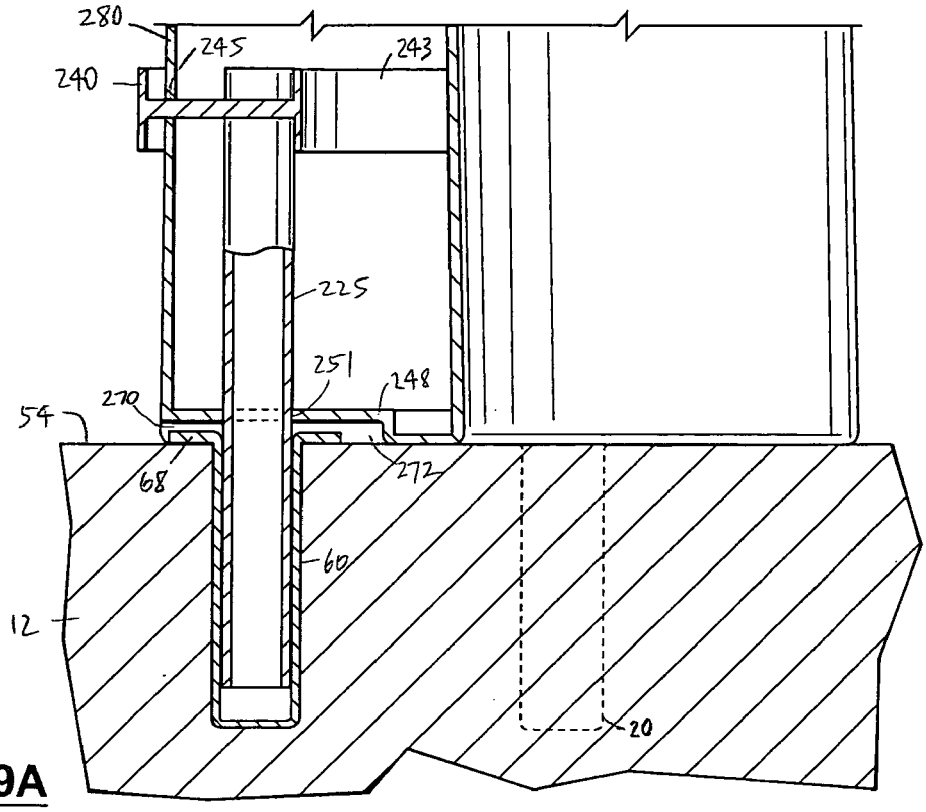
FIG. 9A is a partial cross-section of the bollard of FIG. 6A showing the bollard in position in the receptacle of FIG. 3A, drawn at a larger scale.

As can be seen in FIGS. 6C and 9A, each connecting member 242 includes an internal part 244 with a wall contact portion 245 integrally attached to the front wall 280. Also, the internal part 243 of the bumper 240 includes wall contact portions 285, 287 which are also integrally attached to the front wall 280. The exposed part 241 of the bumper 240 is that part of the bumper 240 which is positioned outside the body 214.

The body 214 is preferably made using rotational molding, and the bollard 210 is preferably made in a rotational mold accordingly. The mounting element 218 is first placed in the mold, and the hot plastic material is then added into the mold. As discussed, a plastic body formed using rotational molding is virtually stress-free and has other advantages, as is known in the art. However, as the plastic in the body 214 cools, it bonds with the wall contact portions 245 (of the connecting members 242) and the wall contact portions 285, 287 (of the bumper 240), resulting in integral attachment (FIG. 6C).

Figure 9B:
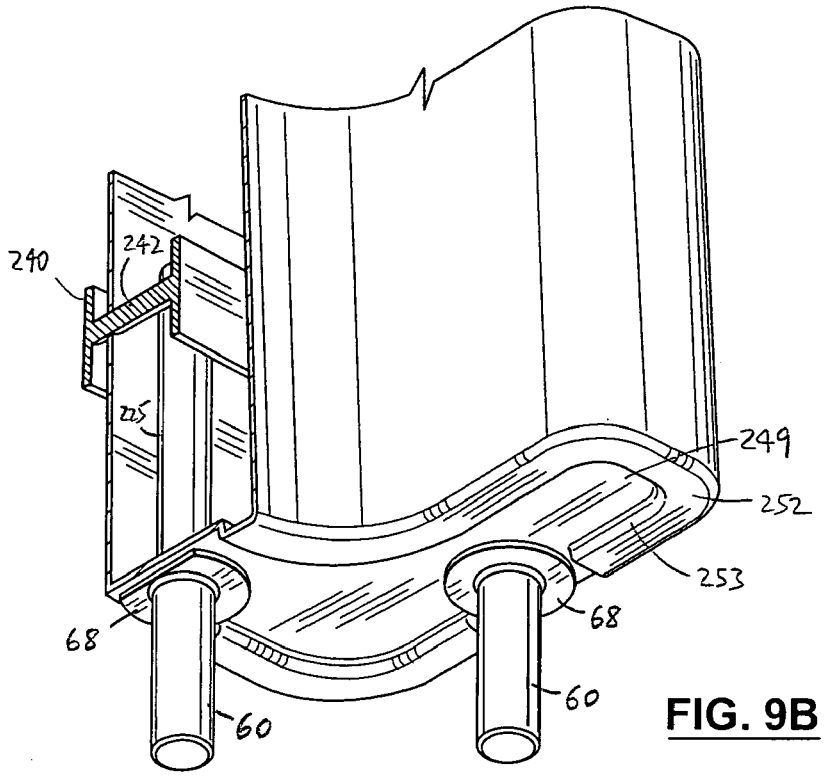
FIG. 9B is an isometric view of the bollard of FIG. 9A from the bottom, showing the mounting element received in receptacles, partially cut away to show the mounting element positioned inside the body.

The body 214 also includes an end wall portion 248 to which each post 225, 226 is integrally attached (FIGS. 6B, 9A). Specifically, the posts 225, 226 include cap contact portions 251 which are integrally attached to the end wall portion 248. In the preferred embodiment, the end wall portion 248 includes a central portion 249 which is arched so that it is generally spaced apart from the surface 54 when the bollard 210 is mounted on the base 12 (FIGS. 6B, 8B, 9A). Also, the body 214 includes one or more contact surfaces 252 at the bottom end 216 thereof, adapted to seat snugly upon the surface 54 (FIGS. 9A, 9B). The end wall portion 248 also includes one or more connecting segments 253 connecting the contact surfaces 252 to the central portion 249.

As can be seen in FIGS. 9A and 9B, the central portion 249 is configured so that it is spaced apart from the surface 54 when the bollard 214 is mounted on the base (or floor) 12 to provide a recess 272 into which the flange portion 68 fits without interfering with the body 214. A gap 270 is defined between the flange portion 68 and the central portion 249 (FIG. 9A). The contact surfaces 252 (and, to the extent that they are coplanar with the contact surfaces 252, the connecting segments 253) seat the body 214 on the surface 54.

However, as can be seen in FIGS. 9A and 9B, because of the proximity of the posts 225, 226 to the front wall 280, the contact surfaces 253 are discontinued in those parts of the front wall 280 adjacent to the posts 225, 226 respectively. This is necessary to permit the flange portions 68 to be received underneath the body 214 without interfering with the seating of the body 214 on the surface.

In the preferred embodiment, the external parts 224 of the posts 225, 226 are received in receptacles 60 (FIGS. 9A, 9B) positioned in the base 12 (FIG. 9A). The external parts 224 are preferably receivable in the receptacles 60 respectively in a clearance fit. The bollard 210 is therefore relatively easily removed from the receptacles 60 to permit cleaning of the floor surface 54 in the vicinity of the receptacles 60.

It will be appreciated by those skilled in the art that the invention can take many forms, and that such forms are within the scope of the invention as claimed. Therefore, the spirit and scope of the appended claims should not be limited to the description of the preferred version contained herein.

I claim:

1. A bollard to be positioned in a predetermined location on a base, the bollard having:

an elongate body;

a mounting element integrally attached to the body, the mounting element being adapted to be positioned in the base in the predetermined location, to locate the body on the base;

the mounting element having at least one post for insertion in at least one hole in the base to position said at least one post at the predetermined location;

said at least one post being receivable in said at least one hole in a clearance fit;

the body having a bottom end adapted for seating on the base in the predetermined location;

the body including a wall having an exterior surface;

the mounting element including a bumper connected to said at least one post by at least one connecting member extending through the wall to position at least an exposed part of the bumper outside the body a predetermined distance from the exterior surface, for protecting the body;

said at least one connecting member comprising an internal part including a wall contact portion integrally attached to the wall and an external part positioned outside the body to support the exposed part of the bumper; and the body including an end cap extending from said at least one post to the wall of the body, the end cap including a central portion located adjacent to said at least one post, the central portion being located substantially above the base when the bollard is positioned on the base.

2. A bollard according to claim 1 in which said at least one post comprises an internal part including a cap contact portion integrally coupled with the end cap and an external part extending beyond the end cap, the external part being receivable in said at least one hole.

3. A bollard to be positioned in a predetermined location on a base, the bollard having:

an elongate body;

a mounting element integrally attached to the body, the mounting element being adapted to be positioned in the base in the predetermined location, to locate the body on the base;

the mounting element having at least one post for insertion in at least one hole in the base to position said at least one post at the predetermined location;

said at least one post being receivable in said at least one hole in a clearance fit;

the body having a bottom end adapted for seating on the base in the predetermined location;

the wall terminating in a contact surface at a bottom end of the body, the contact surface being adapted to seat upon the base;

the contact surface of the wall forming a ring substantially defining a plane, for seating upon a substantially planar top surface of the base;

the body including an end can extending from the wall at the bottom end to the post, the end cap being positioned relative to the contact surface of the wall such that, when the bollard is mounted to the base, the end cap is positioned substantially above the base; and the end can having a substantially concave shape relative to the base.

4. A bollard assembly adapted to be positioned on a base, the bollard assembly including:

a bollard having:

an elongate body with a bottom end adapted for engagement with the base;

a mounting element for mounting the body to the base, the mounting element having an internal portion positioned at least partly inside the body and integrally attached to the body, and at least one external portion connected to the internal portion;

said at least one external portion of the mounting element extending from the bottom end of the body, the body being located on the base by said at least one external portion;

at least one receptacle for receiving said at least one external portion such that the bottom end engages the base, said at least one receptacle being positionable in the base;

said at least one receptacle including:

a housing defining at least one hole in which said at least one external portion is receivable, the housing having a housing bottom end, to be located in the base, and a housing top end, positioned distal to the housing bottom end;

a flange portion extending transversely from the top end of the housing, for cooperating with a top surface of the base to sit on the surface, to locate the bottom end of the housing a predetermined depth below the surface;

the bottom end of the housing including an end wall portion for partially defining said at least one hole, located distal to the flange portion;

said at least one external portion comprising an external part of at least one post, said at least one post having an internal part thereof included in said at least one internal portion;

the external part of said at least one post being receivable in said at least one hole in a clearance fit; and the body including a wall and the mounting element including a bumper connected to said at least one post by at least one connecting member, said at least one connecting member being integrally coupled with the wall, said at least one connecting member extending through the wall and being integrally attached to the wall, to position an exposed part of the bumper a predetermined distance outside the body, for protecting the body.

5. A bollard to be mounted on a base, the bollard including:

an elongate body having a bottom end adapted for engagement with the base;

a mounting element for mounting the body to the base, the mounting element having an internal portion positioned at least partly inside the body and integrated with the body, and at least one external portion connected to the internal portion;

said at least one external portion extending from the bottom end of the body and adapted to locate the body on the base;

the mounting element additionally including an exposed part of at least one bumper connected to said at least one internal portion, the exposed part being positioned outside the body above the bottom end, for protecting the body;

said at least one external portion comprising an external part of at least one post, said at least one post being included in the mounting element and integrally attached to the body, the external part of said at least one post extending beyond the body and being receivable in at least one hole in the base;

the body comprising an at least partially hollow tube with a body wall substantially defined by a longitudinal axis, the body being substantially coaxial with the longitudinal axis; and said at least one post including a first end positioned distal to the bottom end of the body and an aperture in the first end positioned substantially transverse to the longitudinal axis, and in which the bollard additionally includes a retainer pin receivable in the aperture, for retaining the first end in the base.

6. A method of mounting a bollard on a base, the method comprising the steps of:

(a) providing a bollard having:

an elongate body with a bottom end adapted for engagement with the base;

a mounting element for mounting the body to the base, the mounting element having an internal portion positioned at least partly inside the body and integrally attached to the body, and at least one external portion connected to the internal portion;

said at least one external portion extending from the bottom end of the body and being mountable to the base to locate the body on the base;

said at least one external portion including a first end positioned distal to the bottom end of the body and an aperture in the first end positioned substantially transverse to said at least one external portion;

a retainer pin receivable in the aperture;

(b) providing at least one hole in the base, said at least one external portion being receivable in said at least one hole;

(c) inserting the retainer pin in the aperture;

(d) inserting said at least one external portion into said at least one hole with the retainer pin inserted in the aperture; and (e) backfilling material into said at least one hole onto said at least one external portion and the retainer pin, such that the bottom end of the body engages the base.

* * * * *